US007181380B2

(12) United States Patent
Dusterhoft et al.

(10) Patent No.: US 7,181,380 B2
(45) Date of Patent: Feb. 20, 2007

(54) SYSTEM AND PROCESS FOR OPTIMAL SELECTION OF HYDROCARBON WELL COMPLETION TYPE AND DESIGN

(75) Inventors: Ronald G. Dusterhoft, Houston, TX (US); Daniel Moos, Palo Alto, CA (US); Mark David Zoback, Standford, CA (US); Donald Ritter, Dallas, TX (US); Martin Brudy, Nierstein (DE)

(73) Assignees: Geomechanics International, Inc., Houston, TX (US); Halliburton Energy Services, Inc., Duncan, OK (US)

( * ) Notice: Subject to any disclaimer, the term of this patent is extended or adjusted under 35 U.S.C. 154(b) by 723 days.

(21) Appl. No.: 10/324,940

(22) Filed: Dec. 20, 2002

(65) Prior Publication Data

US 2004/0122640 A1 Jun. 24, 2004

(51) Int. Cl.
*G06G 7/48* (2006.01)

(52) U.S. Cl. ..... 703/10; 702/13; 166/250.1; 166/250.07

(58) Field of Classification Search ..... 703/10; 702/11–14; 166/250.07, 250.1, 245, 252.1
See application file for complete search history.

(56) References Cited

U.S. PATENT DOCUMENTS

| | | | | |
|---|---|---|---|---|
| 3,727,688 A | | 4/1973 | Clampitt | 166/283 |
| 4,637,461 A | * | 1/1987 | Hight | 166/245 |
| 4,702,314 A | * | 10/1987 | Huang et al. | 166/245 |
| 4,828,028 A | | 5/1989 | Soliman | 166/250 |
| 4,836,284 A | | 6/1989 | Tinker | 166/279 |
| 4,848,467 A | | 7/1989 | Cantu et al. | 166/281 |
| 5,103,905 A | | 4/1992 | Brannon et al. | 166/250 |
| 5,217,074 A | | 6/1993 | McDougall et al. | 166/300 |
| 5,325,921 A | | 7/1994 | Johnson et al. | 166/280 |
| 5,558,161 A | | 9/1996 | Vitthal et al. | 166/280 |
| 5,743,334 A | | 4/1998 | Nelson | 166/250.07 |
| 6,012,016 A | | 1/2000 | Bilden et al. | 702/12 |
| 6,076,046 A | | 6/2000 | Vasudevan et al. | 702/12 |
| 6,266,619 B1 | * | 7/2001 | Thomas et al. | 702/13 |
| 6,318,464 B1 | * | 11/2001 | Mokrys | 166/252.1 |
| 6,356,844 B2 | * | 3/2002 | Thomas et al. | 702/12 |
| 6,364,015 B1 | | 4/2002 | Upchurch | 166/250.1 |
| 6,853,921 B2 | * | 2/2005 | Thomas et al. | 702/14 |

OTHER PUBLICATIONS

Ullo, J. Recent Developments in Seismic Exploration and Reservoir Characterization, IEEE, Ultrasonics Symposium, vol. 1, Oct. 1997, pp. 787-796.*

(Continued)

*Primary Examiner*—Russell Frejd
(74) *Attorney, Agent, or Firm*—Robert A. Kent; Conley Rose

(57) ABSTRACT

A process to determine optimal completion type and design prior to drilling of a hydrocarbon producing well utilizing information from hydrocarbon recovery modeling such as reservoir, geo-mechanical, and material modeling over the production life of the well. An embodiment of the process includes obtaining information regarding pore pressure depletion, stress magnitudes and orientations, and strength of rock formation from hydrocarbon recovery modeling to determine optimum well completion design including the selection of a completion type, trajectory, and location. Additionally, the process may also consider probable failure mechanisms and identified completion requirements, and their corresponding effect on completion options.

33 Claims, 5 Drawing Sheets

OTHER PUBLICATIONS

Young et al., L.C. High Performance Vector Processing in Reservoir Simulation, Proceedings of the 1991 ACM/IEEE Conference on Supercomputing, Aug. 1991, pp. 304-315.*

Beekman et al., F. Faulting, Fracturing and In Situ Stress Prediction in the Ahnet Basin, Algeria—A Finite Element Approach, Tectonophysics, vol. 320, Nos. 3-4, May 2000, pp. 311-329.*

"Experience Proves Forced Fracture Closure Works" by John W. Ely in the World Oil published in Jan. 1996.

"Horizontal Well will be Employed in Hydraulic Fracturing Research" Published in the Oil & Gas Journal on May 20, 1991.

Soliman, M.Y. and Hunt, J.L., "SPE 14515—Effect of Fracturing Fluid And Its Cleanup on Well Performance," Society of Petroleum Engineers, 12 pp. (1985).

Soliman, Mohamed, "Fracture Conductivity Distribution Studied," Technology—Oil & Gas Journal, pp. 89-93 (Feb. 10, 1986).

Poulsen, D.K. and Soliman, M.Y., "SPE 15940—A Procedure for Optimal Hydraulic Fracturing Treatment Design," Society of Petroleum Engineers, 8 pp. (1986).

Economides, M.J. and Nole, K.G., "Reservoir Simulation 3rd Edition," John Wiley and Sons, LTD (2000), pp. 8-18 through 8-23.

Mobbs, A.T. and Hammond, P.S., "Computer Simulations of Proppant Transport in a Hydraulic Fracture," SPE Production & Facilities, May 2001, pp. 112-121.

Leal, L.G., "Particle Motions in a Viscous Fluid," Ann. Rev. Fluid Mech. (1980), 12:435-76.

Cleary, M.P. and Fonseca, Jr., Amaury, "Proppant Convection and Encapsulation in Hydraulic Fracturing: Practical Implications of Computer and Laboratory Simulations," SPE 24825, prepared for Presentation at the 67th Annual Technical Conference and Exhibition Of the Society of Petroleum Engineers held in Washington, D. C., Oct. 1992.

Pearson, J.R.A., "On Suspension Transport in a Fracture: Framework for A Global Model," Journal of Non-Newtonian Fluid Mechanics 54 (1994) 503-513.

Wheeler, J.A., "Analytical Calculations for Heat Transfer from Fractures," SPE 2494 (1969).

Kamphius, H., Davies, D.R. and Roodhart, L.P., "A New Simulator for The Calculation of the In-Situ Temperature Profile During Well Stimulation Fracturing Treatments," Paper No. CIM/SPE 90-46, presented At the International Technical Meeting jointly hosted by the Petroleum Society of CIM and the Society of Petroleum Engineers in Calgary, Jun. 1990.

Nolte, Kenneth, G., "Fluid Flow Considerations in Hydraulic Fracturing," SPE 18537, prepared for presentation at the SPE Eastern Regional Meeting in Charleston, West Virginia, Nov. 1988.

Perkins, T.K. and Kern, L.R.: "Widths of Hydraulic Fractures," Journal of Petroleum Technology, Sep. 1961, pp. 937-949.

Ramey, Jr., H.J., "Wellbore Heat Transmission," Journal of Petroleum Technology, Apr. 1962, pp. 427-435.

Wooley, Gary R. "Computing Downhole Temperature in Petroleum and Geothermal Wells," SPE 8441, presented at the 54th Annual Fall Technical Conference and Exhibition of the Society of Petroleum Engineers of AIME, held at Las Vegas, Nevada, Sep. 1979.

Morita, N., et al., "Typical Sand Production Problems: Case Studies and Strategies for Sand Control," SPE 22739, Society of Petroleum Engineers, Inc., Oct. 1991, pp. 801-812.

Morita, Nobuo, et al., "Fracturing, Frac-Packing and Formation Failure Control: Can Screenless Completions Prevent Sand Production!", SPE 36457, Society of Petroleum Engineers, Inc., Oct. 1996, pp. 391-402.

Norman, W.D., et al., "Understanding the Effects of Reservoir Changes in Sand-Control Completion Performance," SPE 96307, Society of Petroleum Engineers, Inc., Oct. 2005, pp. 1-10.

* cited by examiner

SYSTEM AND PROCESS FOR OPTIMAL SELECTION OF HYDROCARBON WELL COMPLETION TYPE AND DESIGN

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention generally relates to the selection of hydrocarbon well completion type and design. More specifically, the invention relates to a process for selecting optimal well completion type and design for desired well production over the life of the well, based on information from physical and process modeling (referred to herein as 'hydrocarbon recovery modeling') such as reservoir, geo-mechanical, and material modeling.

BACKGROUND OF THE INVENTION

In an effort to economically develop oil and/or gas producing reservoirs, the Petroleum Industry relies heavily upon educated predictions of reservoir conditions utilizing technologies available for reservoir characterization prior to making enormous investments into the drilling and completing of wells. Evaluating known data from similar reservoirs as well as actual data obtained from exploratory wells or other early development efforts can greatly enhance the industries ability to optimize the development and management of a hydrocarbon-producing field. Hydrocarbon recovery modeling using sophisticated computer simulation of reservoir processes and physical characteristics has become a critical evaluation tool for effective and economical reservoir development and management.

Typically, hydrocarbon recovery modeling of reservoirs includes both fluid-dynamical modeling of multi-phase transport in permeable media, generally by numerical analysis methods incorporated into reservoir simulators, as well as geo-mechanical modeling that may utilize structural analysis software packages. Additionally, hydrocarbon recovery modeling can include material modeling of the physical properties of the reservoir's rock formations. Many software computer programs used for this modeling are generally available within the industry.

Reservoir simulators provide a tool that can be utilized by reservoir engineers to make predictions about the multi-phase flow of oil, gas, and water in underground hydrocarbon accumulations. Engineers can simulate various methods of producing oil fields, and can experiment with locations and design of wellbores to optimize both the recoveries of such resources as well as their own business profitability. Reservoir models use various laws, for example Darcy's law, to relate rock parameters such as porosity, absolute and relative permeability, and capillary pressure to quantify the pressure, flux and dissipation of a reservoir.

Geo-mechanical technologies characterize rock properties to predict the state of earth stresses and natural fractures and or faults in a formation. Geo-mechanical models are based on various laws, such as Hooke's law, to relate rock parameters such as elastic and plastic rigidity to quantify the displacement, stress and internal energy of a reservoir. Traditionally, geo-mechanical modeling of hydrocarbon reservoirs is evaluated at static reservoir conditions, such as pre-drilling reservoir conditions. Generally the evaluation is primarily focused on optimization of the actual drilling process, for example to design a drilling program that eliminates or minimizes mechanical instabilities in the borehole while drilling a well. As a result, much of the focus of the geo-mechanical studies is on weak shale sections or depleted reservoirs that tend to create drilling hazards.

In most situations in the petroleum industry, completions are designed to accommodate a given wellbore based upon reservoir drainage recommendations. These reservoir drainage models can be used to determine the most efficient drainage points within the reservoir and can also be used to evaluate the basic type of completion whether it is a horizontal wellbore, a deviated wellbore or a vertical wellbore. Using this approach the well planning is done to hit the desired drainage target and to minimize the development cost through proper placement of individual well locations or central drilling sites.

In many cases the hydrocarbon producing reservoirs exist in a normal fault regime where there is little directional preference for both wellbore stability or completion selection. As a result, they are quite forgiving to different completion options. There are, however, a number of regions around the world that are in more complex stress states, sometimes transitioning from a normal faulting regime to strike slip or even reverse fault conditions. When these conditions exist, there can be a very strong directional preference for optimum completion design. In those conditions proper alignment and placement of the wellbore based upon specific completion techniques can vastly improve the reliability and productivity of the wellbore.

SUMMARY OF THE INVENTION

A process is disclosed to utilize hydrocarbon recovery modeling such as reservoir, geo-mechanical, and material modeling to further consider and determine well completion type and design prior to drilling in order to achieve desired performance and production over the life of the well and reservoir. In addition, the pre-drill selection of completion type and design can also be used to determine the most efficient way to drill the well. The hydrocarbon recovery models can provide information regarding pore pressure depletion, stress magnitudes and orientations, and strength of rock formation, all of which can be used in determining optimum well completion design to include the selection of a completion type, trajectory, and location.

An embodiment of the process includes determining the effect of pore pressure depletion on well production over the life of the well and the resultant impact on well completion options. It may also include consulting hydrocarbon recovery models to determine the probable failure mechanism for a proposed well and the resulting effect on well production and completion options. In addition, the effects of completion requirements may also be identified for the well in order to further identify appropriate completion options. Evaluating each of these effects concurrently or systematically can help determine the optimum completion design. The well can then be drilled and completed based on the determination of the desired completion design. Information used in the hydrocarbon recovery models can be updated with data obtained during drilling and completion of the well. The process can be repeated for each new proposed well.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

The following-detailed description discloses a system and process in accordance with the present invention that uses specific geo-mechanical, reservoir, and material knowledge such as that obtained from hydrocarbon recovery modeling, to provide a means of optimizing the completion selection process in the pre-drill planning stages of the well, helping to achieve the best wellbore performance over the life of the well. In doing this, an additional level of detail is added to the well planning process identifying not only the drainage location, but also the optimum orientation, deviation, and completion type at this point as well.

Since stress in the reservoir is a function of pore pressure, the optimum completion would also be designed to accommodate the stress changes that would occur during the production of the reservoir. This makes it possible to select the optimum completion for the life of the well based upon expected changes in reservoir conditions due to depletion. Such changes may include shear induced fines migration, reservoir compaction, or fault activation (or re-activation), all of which can pose serious challenges to completion reliability which should be accounted for in the initial design.

Depending on the stress conditions in the reservoir, the most stable wellbore trajectory may be aligned with the preferred fracturing plane or may be as much as 90 degrees different from the preferred fracturing plane. Therefore, it becomes very important to have the desired completion technique verified early in the well planning process to ensure the wellbore is drilled in the most favorable trajectory. As an example, non hydraulically fractured completions such as open hole, cased and perforated, or gravel packed, the most favorable wellbore trajectory may be as much as 90 degrees different to the preferred trajectory for a completion that uses hydraulic fracturing.

In some cases, the stress orientations and fault regime may change with depth in the wellbore creating situations where the preferred wellbore orientation may vary if there are multiple productive intervals to be completed in the same wellbore. Under these conditions the completion selection can be made to accommodate well path design. This can be done, for example, by possibly selecting frac and pack or gravel pack completions for upper intervals where a horizontal well would be preferred for the lower interval. The completions can also be designed and optimized during the well planning to minimize the complexity of wellbore trajectories and their associated drilling risk.

Figure 1:
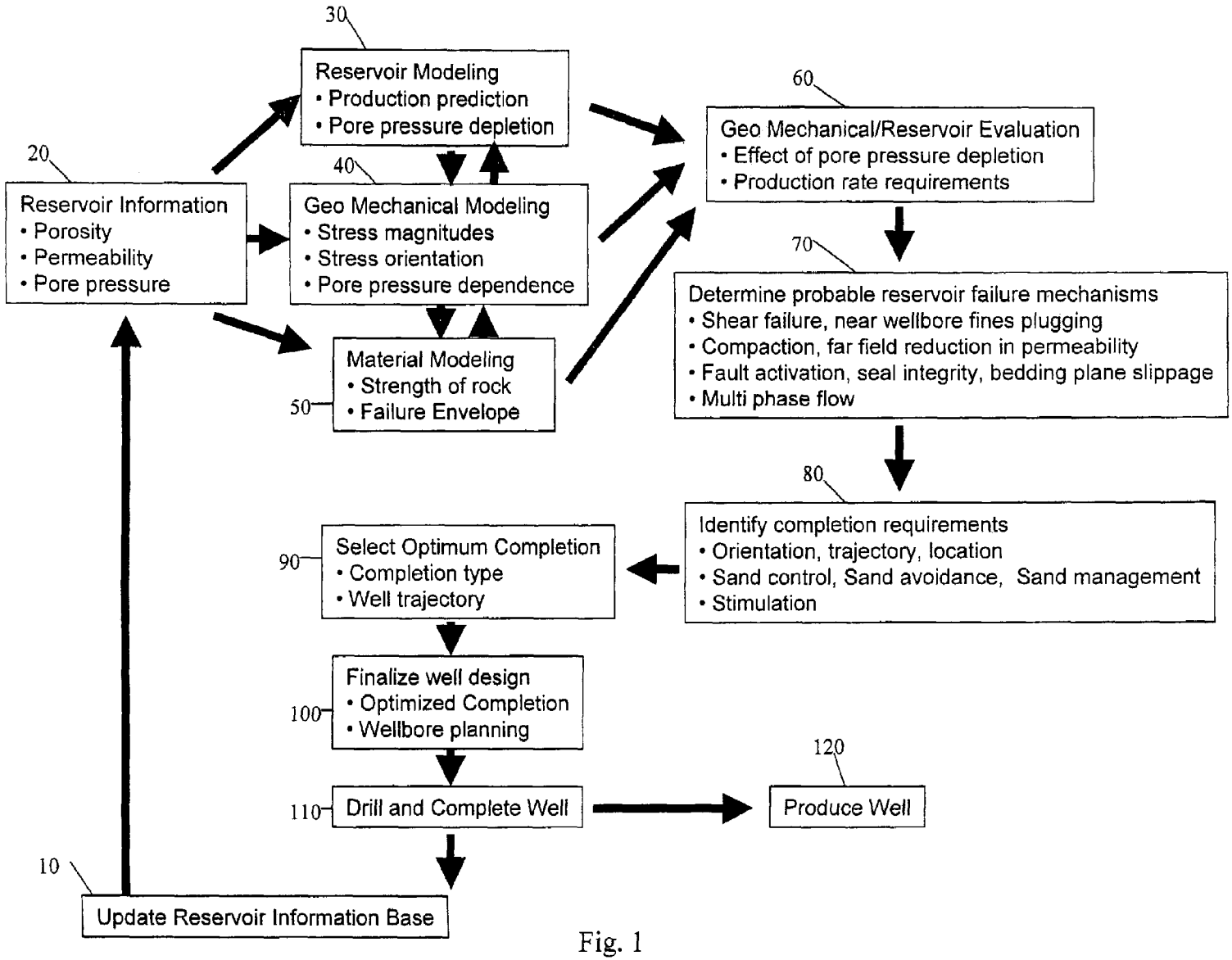
FIG. 1 is a diagrammatic representation of an embodiment of a process in accordance with the present invention to determine well completion type and design using reservoir, geo-mechanical, and material information.

FIG. 1 depicts an embodiment of the process to determine a well's completion type and design in accordance with the present invention. Note that throughout the following detailed description of FIG. 1, it is contemplated that the information generated, evaluated, or however obtained, can pass collectively through the boxes, so that the information base continues to grow. For example, the information from boxes 20, 30, 40, and 50 is available to box 60 where an evaluation of some or all of that information can be made. The information from boxes 20, 30, 40, 50 and now box 60 is then available to box 70 where another evaluation is performed generating additional information. The information generated in boxes 20, 30, 40, 50, 60, and now box 70 is then available to box 80 and so forth. Also to be noted is that many of the specific evaluations made during the process may be known by those of skill in the art. However, these evaluations have traditionally not been performed or combined to determine optimal completion design before drilling the well. Historically, such evaluations have not been done prior to drilling; and if done before drilling at all, the evaluations have not focused on completion options but instead only on drilling concerns, i.e., to minimize costs and risks in the drilling operations. As contemplated by the embodiment of the present invention illustrated in FIG. 1, the evaluations in boxes 20, 30, 40, 50, 60, 70, 80, 90, and 100 are typically performed in the pre-planning stages of a well prior to drilling, to optimize completion design as well as drilling design for the desired well production over the expected life of the well.

As shown in FIG. 1, although the process may be reiterative, initially we will consider box 20. In box 20, reservoir information including physical, structural, and geological information about the reservoir is provided for further processing in subsequent steps. Reservoir properties such as porosity, permeability, pore pressure, etc. and physical data such as rock strength information are obtained by gathering and analyzing available data from any testing of the reservoir as well as from any existing wells in the reservoir. For example, data collected could include core information, open hole and cased hole electric line logs, such as compensated neutron logs, etc., static bottom hole pressures, production flow tests, and possibly even data taken from mud cuttings taken while drilling. As indicated in box 10, the process contemplates that the baseline of reservoir information in box 20 can be continually updated by gathering and analyzing all the available well data as each well is drilled and completed.

The reservoir information 20 provides the feed data to perform various hydrocarbon recovery modeling such as those shown in boxes 30, 40, and 50. In the embodiment of FIG. 1, reservoir modeling occurs in box 30, geo-mechanical modeling occurs in box 40, and material modeling occurs in box 50. The hydrocarbon recovery models shown in boxes 30, 40, and 50 are for modeling hydrocarbon reservoirs. Computer programs are available commercially to perform reservoir modeling in whole or in part, examples include VIP, by Landmark Graphics (Halliburton) and Eclipse, by Schlumberger. For this process, the reservoir model provides information regarding expected pore pressure depletion and reservoir performance predictions, both parameters being a function of time.

A substantial portion of the geo-mechanical modeling 40 may also be performed through the use of software packages, typically for structural analysis, that are also readily available commercially such as SFIB and WELCHECK, both Geomechanics International (GMI) products. Additionally, other tools such as maps showing stress orientation and magnitude can be used for geo-mechanical modeling. Wireline logs can be used to achieve mechanical properties through sonic analysis. Analyzing borehole breakouts using oriented caliper or wellbore imaging logs can also be used to validate the geo-mechanical state of the reservoir. Geo-mechanical modeling 40 of reservoir information includes data taken from existing wells such as borehole breakout, leak off testing for least flexible stresses, and any other reservoir information 20 available. Typically, geo-mechanical modeling 40 provides geo-mechanical information such as stress magnitude and orientation and can be summarized in such common ways as geo-mechanical maps, gradient type plots, stress polygon diagrams, and various other methods used to visualize or display stress magnitude and orientation information. Maps are commonly used to visually display stress direction and typically gradient plots are used to display stress magnitudes. Stress polygons can be used to visually display stress states at various pore pressures. Much of the geo-mechanical information, such as stress, may be a function of pore pressure. Accordingly, this information can be determined at various points in time by inputting pore pressure information (and expected depletion over time) as generated from the reservoir modeling 30. Thus, the stress magnitude and orientation can be generated from geo-mechanical modeling 40 at original reservoir conditions and also at various predicted reservoir conditions to formulate a prediction of the geo-mechanical influences throughout the life of the reservoir.

One common hydrocarbon recovery modeling tool used to determine stress states in the reservoir is the stress polygon. Once the geo-mechanical model 40 is established, the pore pressure can be changed in the model and the new geo-mechanical state can be output in such visual displays as a stress polygon. When the pore pressure changes, the stress polygon changes or shifts. Therefore, the calculations to generate a stress polygon are generally repeated at each pore pressure through time to determine the stress state at the various conditions. This information can then be fed into another hydrocarbon recovery modeling tool such as a material model 50 for the failure envelope to subsequently determine probable failure modes throughout the life of the well.

The material model 50 for the failure envelope goes the next step beyond simply the calculation of the stress state. Knowledge of the stress state does not typically consider rock failure. Hydrocarbon recovery models such as stress polygons can be used to determine what the stresses within the reservoir are going to do when the pore pressure changes. Inputting this stress state information into a material model, such as the Mohr Coulomb failure envelope, allows for the evaluation of whether the identified stresses on the rock will have a tendency to fail the rock and if so by what failure mechanism. Many of these material models have traditionally been used as sand production prediction models for existing wellbores. In an embodiment of the present invention, these material models are being used differently, in that their use for failure mechanism determination is done at the pre-drill planning stages of the well in an effort to not only consider sand requirements but to design a better completion for that well and to be able to design and drill a better wellbore for that completion. For example, in an embodiment the resultant well productivity can be improved by inserting the optimum completion in a compaction situation, or can be drilled differently to avoid potential sand production problems.

Material modeling 50 may be performed with the assistance of software packages for evaluating rock strength that are commercially available, such as Sand 3D, by ConocoPhillips and Sand PI, by GMI. Material modeling 50 of the reservoir information 20 typically provides information about the mechanical failure properties of the reservoir rock, and could include both elastic and plastic properties determined at multiple confining stresses. A simple example of an important rock property that can be found through sampling and testing core samples is the Mohr Coulomb failure envelope. The Mohr Coulomb failure envelope delineates stable and unstable states of stress for a given rock material. This envelope is discussed more fully in reference to FIG. 4 below.

With the modeling information from boxes 30, 40, and 50, an evaluation is made in box 60 to determine the effect of pore pressure depletion on the expected production rate requirements of the well. The geo-mechanical influences as predicted by geo-mechanical modeling 40 in combination with the predicted reservoir performance information from reservoir modeling 30 and the failure envelope and rock strength information generated from material modeling 50 may all be evaluated in box 60. Typically, information regarding pore pressure depletion is primarily obtained from corresponding reservoir modeling as shown in box 30. By considering the pore pressure depletion information in context with the geo-mechanical modeling of box 40 and material modeling of box 50, the effect of the changes in pore pressure over time on the geo-mechanics of the well and the corresponding result on well production rates can be evaluated in box 60.

Figure 4:
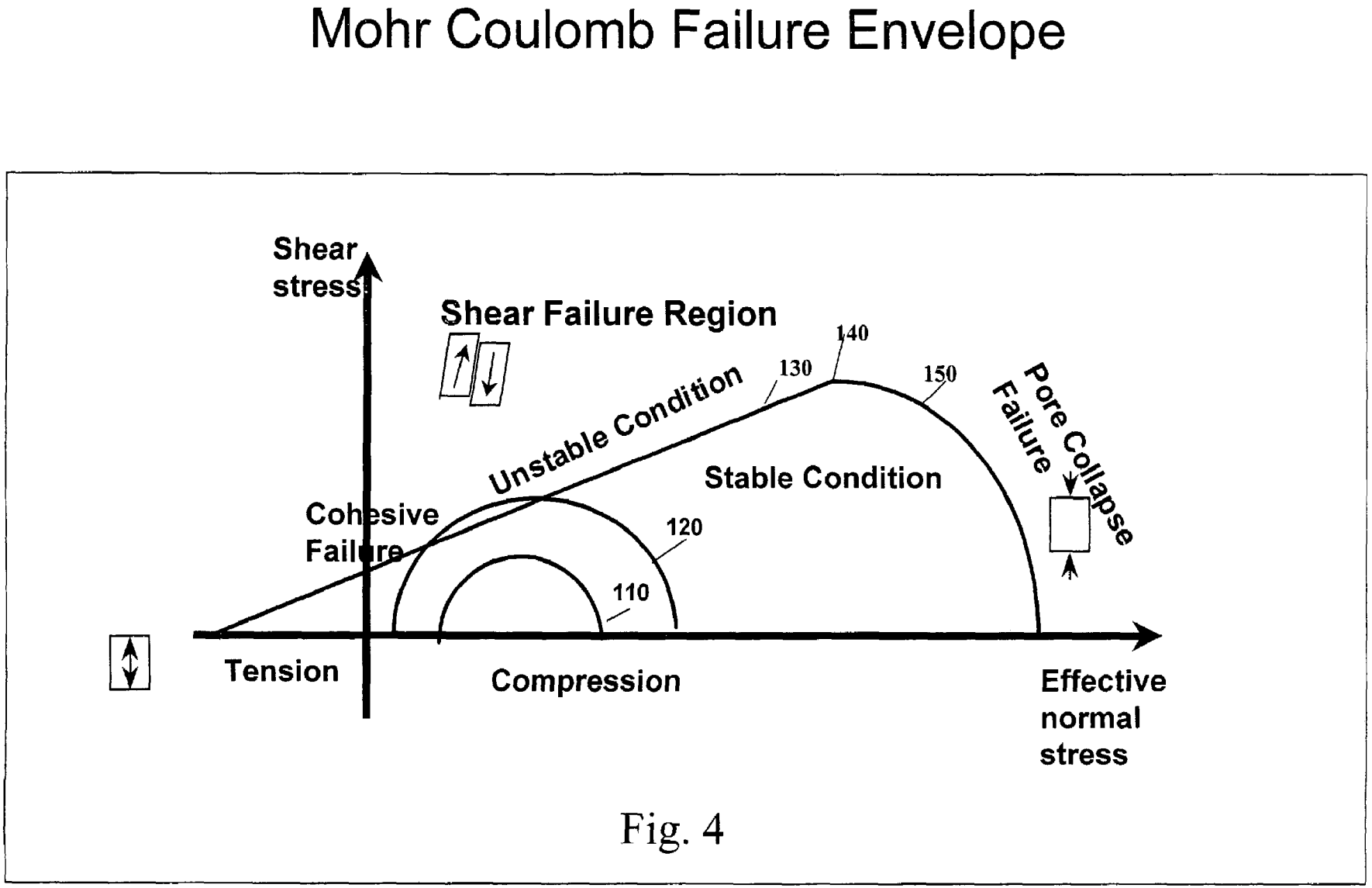
FIG. 4 is a plot of a Mohr Coulomb failure envelope.

In box 70, an evaluation is made to determine the probable reservoir failure mechanisms expected. The probable reservoir failure mechanism is determined from the information provided by the hydrocarbon recovery models 30, 40, 50 as well as the evaluation of the effect of pore pressure depletion from box 60. Often software vendors of various hydrocarbon recovery models have classes available for instruction on how to use their software packages and may additionally teach basic techniques on how to use their model in reservoir evaluations. For example, one such technique that is generally known to those skilled in the art, or that could be quickly learned by one of ordinary skill in the art through appropriate instruction, would be to use a simple Mohr Coulomb failure envelope as depicted in FIG. 4 to identify what characteristics could lead to various failure mechanisms in a reservoir. This example will be described in greater detail below in the discussion of FIG. 4. As indicated in box 70, common failure mechanisms include shear failure (which can result in near wellbore fines plugging), compaction (which is a far field reduction in permeability), fault activation (which may challenge seal integrity or create bedding plane slippage), and/or multi-phase flow (which can induce production problems as well). Accordingly, depending on the particular geo-mechanical influences within the formation, the selection of completion types can be more narrowly defined by choosing from a group of completion types appropriate for the predicted failure mechanism. The relationship between failure mechanisms and completion options will be discussed more fully below in reference to FIG. 2.

Having identified the most probable reservoir failure mechanism or mechanisms the process continues on to box 80 of FIG. 1. In box 80, an evaluation is made of the completion requirements in accordance with productivity considerations, such as sand management concerns. As shown in box 80, other completion requirements considered include the well's orientation, trajectory, location, and whether the well will require stimulation to meet production rate requirements. In addition, an evaluation is made of the effect these completion requirements will have on available completion options. The relationship between one such completion requirement, sand management requirements, on the options for completion will be discussed more fully in reference to FIG. 3 below.

Completion requirements can be from a set of production rate requirements that are defined by an asset team in the production company, including concerns such as minimum and maximum production flow rates and well longevity. Typically, a production company decides to sanction a project based on economics, which translates into certain production requirements, such as required number of barrels of oil per day per well. Those production rate requirements then affect the decision as to how the wells should be completed. Accordingly, to achieve those requirements an evaluation of many factors come into play such as sand control, including decisions on whether sand production should be managed or avoided completely, or whether the well will require stimulation to meet the production requirement. Traditionally, these decisions are made for a well plan or wellbore already in place. The well's orientation, trajectory, and location are already set when the decisions are being made as to whether sand control or sand avoidance is required or whether to stimulate the well.

In an embodiment of the present invention, these decisions are made in the pre-drill planning stages of a well, optimizing the orientation and trajectory for the expected conditions discovered through the substantial evaluation process disclosed herein. In the more traditional situation with the well plan or wellbore in place when completion options are evaluated, it may be determined that the well requires some sort of sand control completion. However, when the well completion type and design is optimized through a pre-drill evaluation as disclosed, the well design could potentially properly orient the wellbore through the formation to avoid sand production altogether.

Having evaluated the effects of pore pressure depletion in box 60, probable failure mechanisms in box 70, and completion requirements in box 80, an optimal completion can now be selected. Referring again to FIG. 1, selection of an optimal completion, including a completion type and the ideal borehole trajectory for the selected completion type, for the overall well design can now be made in box 90. The selection process is performed by evaluating all information available including the determined reservoir failure mechanisms from box 70 with the corresponding completion options listed in FIG. 2, as well as the identified completion requirements for productivity concerns in box 80 of FIG. 1 with the corresponding completion options listed in FIG. 3. It should also be noted that there could be a reiterative process between the boxes 70, 80, and 90. To provide a quick example, however, if it has been determined that the most likely reservoir failure mechanism of box 70 is reservoir compaction, then from table 72 of FIG. 2 appropriate completion options for consideration in well planning would include frac and pack completion, horizontal gravel pack, high angle well with gravel pack, and hydraulic fracturing. If it has also been determined that the most likely completion requirement is for sand avoidance, then from table 84 of FIG. 3 appropriate completion options for consideration in well planning would include orientated perforating, selective perforating, horizontal well, high angle wells, hydraulic fracturing, and consolidation. Since both scenarios affect the well's outcome, the completion requirements listed in both table 72 of FIG. 2 and table 84 of FIG. 3 should be considered, limiting the overall selection to two choices between high angle well and hydraulic fracturing. Alternatively, any combination of mechanisms and subsequent completion requirements can be cross-referenced between the tables in FIG. 2 and FIG. 3, in a similar fashion as was just described.

Once a completion type has been selected, an ideal well trajectory can be reevaluated for the particular completion type selected, again consulting the information from boxes 60, 70 and 80 as well as the modeling information from boxes 30, 40, and 50. Upon selection of the optimum well completion and trajectory, the process passes to box 100 where the overall well design for the optimized completion and wellbore plan are finalized. This may involve moving drill centers from the location previously determined without the application of the process of this invention. The process then proceeds to box 110 where the well is drilled and completed accordingly and on to box 120 where the well is brought on line for production. As indicated in box 10, the process could be reiterated by feeding the additional information gained from the newly drilled well into the updates of the reservoir information in box 20, and repeating the process steps as already described in order to determine the effects of this information on subsequent wellbore completion selections.

It should be noted that some portions of the evaluations made in boxes 60, 70, 80, and 90 might be performed manually by engineers or ones skilled in the art. For example, observations may be performed using available information such as mappings, pore pressure depletion predictions, production strategies, reservoir stresses, and strengths of rock, etc., to determine the probable reservoir failure mechanisms in box 70 as well as to identify completion requirements for productivity expectations in box 80.

Figure 2:
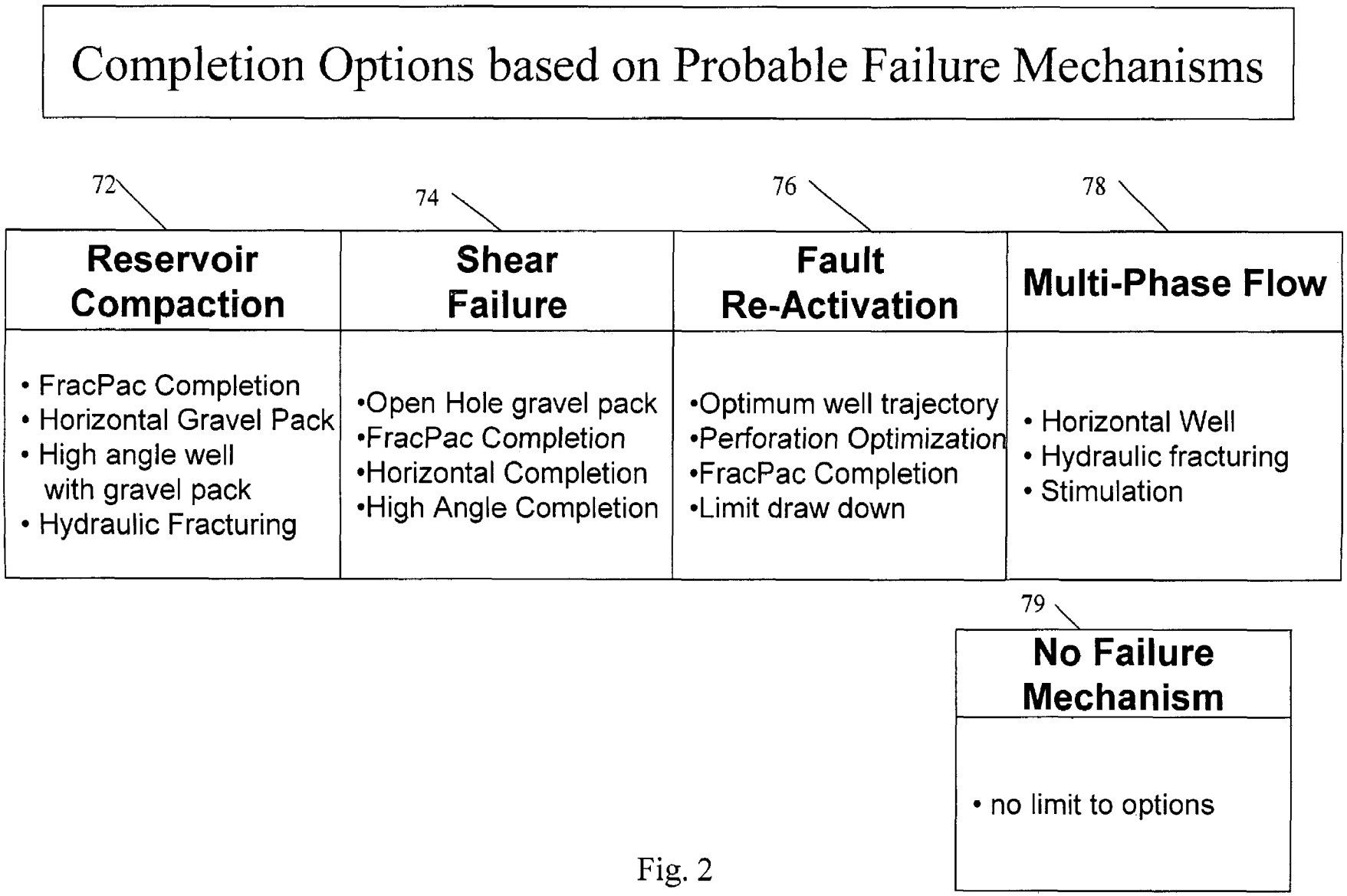
FIG. 2 is a table of well completion options based on probable reservoir failure mechanisms.

FIG. 2 provides a table of completion options for the various potential reservoir failure mechanisms possible in hydrocarbon formations. In box 70 of FIG. 1, the most probable failure mechanisms were determined. FIG. 2 illustrates how these probable failure mechanisms impact completion selection. The failure mechanisms include reservoir compaction, shear failure, fault reactivation, multiphase flow, and no failure. Reservoir compaction, shear failure, and fault activation or re-activation can lead to well casing damage or deformations such as compression, shear, buckling, and bending posing significant challenges to continued operation of the well and which may severely reduce well productivity.

A quick summary of the information shown in FIG. 2 may be helpful. If reservoir compaction is identified as a probable reservoir failure mechanism, column 72 of FIG. 2 lists appropriate completion options for consideration in well planning and includes frac and pack completion, horizontal gravel pack, high angle well with gravel pack, and hydraulic fracturing. If shear failure is identified the appropriate completion options to consider include open hole gravel pack, frac and pack completion, horizontal completion, and high angle completion, as listed in column 74. If fault re-activation is identified as a probable failure mechanism then column 76 lists the appropriate completion options for this mechanism which include optimum well trajectory, perforation optimization, frac and pack completion, and limit drawdown. Drawdown is the difference between static and flowing bottom-hole pressures. If multi-phase flow is identified as a potential failure mechanism then column 78 lists the appropriate completion options for this mechanism including horizontal well, hydraulic fracturing, and stimulation. In the case where there are no failure mechanisms, as indicated in column 79, this factor would not limit the completion options. Accordingly, if there are no failure mechanisms present other factors may determine completion selection such as cost, or other completion requirements such as those shown in FIG. 3 (discussed more fully below).

Although presented here as a failure mechanism, reservoir compaction can provide significant drive energy to greatly enhance the production and recovery of reserves present in a hydrocarbon formation. However, increased amounts of reservoir compaction due to pore pressure depletion, such as occurs during hydrocarbon production, may cause problems. Reservoir compaction during depletion may not only increase the earth stresses but may also change the reservoir stress path. This can lead to well casing damage and ultimately to well failure. Generally the weight of overburden sediments above a hydrocarbon formation is supported by the rock matrix as well as the fluids that are under pressure within the pore space of the rock. As the reservoir is produced, more of the overburden load is transferred to the rock matrix typically causing formation compaction. Pore pressure depletion, rock compressibility, and the structure of the formation determine the magnitude and direction of compaction. The magnitude and direction of the reservoir compaction affects the probable failure mechanism of the well.

Reservoir compaction generally results in a far field loss in permeability extending significantly away from the near wellbore region and deep into the reservoir. This presents a serious condition especially if it is unexpected. Incorrectly completing wells in this environment can cause productivity to drop off dramatically very early in the life of the reservoir. If this scenario is anticipated, completion selection criteria could include stimulating the well in preparation for that loss of permeability or alternatively, an option would be to drill a horizontal well which maximizes the area exposed making production feasible in the reduced permeability reservoir. As indicated in table 72 of FIG. 2, typical completion options which help to alleviate the effect of reservoir compaction on the productivity of the well include frac and pack completion, horizontal gravel pack, high angle well with gravel pack, and hydraulic fracturing.

Stress within a reservoir can be defined to be three dimensional, having a vertical stress element and two horizontal stress elements. Depending on the initial reservoir stress conditions, there may be a case where one stress element is dominant or possibly two stress elements are dominant. The magnitude of the differences between the stress elements will determine to some extent, whether early shear failure may occur, causing localized grain movement and shifting in the near wellbore region when drawdown is applied. Historically, shear is a common failure mechanism of many hydrocarbon reservoirs and is often associated with formation sand production and/or fines migration.

The shear stress failure mechanism is considered a near-wellbore phenomenon, in that it results in a loss of permeability in the near wellbore region. If this is the suspected failure mechanism, then a well completion can be designed to bypass the near wellbore, maintaining high productivity throughout the life of the well, even though a significant loss in permeability may occur near the wellbore as it is produced. As indicated in table 74 of FIG. 2, typical completion options which help to alleviate the effect of shear failure on the productivity of the well include open hole gravel pack, frac and pack completion, horizontal completion, and high angle completion.

The influences of formation compaction caused by the volumetric changes in the reservoir pore space as the reservoir pressure drops during production can be substantial. This subsurface compaction within a reservoir can sometimes be great enough to cause significant alterations in both the vertical and horizontal stress directions. These influences can cause surface subsidence that has been known to result in offshore platforms to partially submerge. The influence can even be great enough to affect the bedding plane stability and can induce fault movement or fault re-activation, in which case well casings can be seriously damaged.

The compaction rate can be a major issue when planning wells including the drilling design as well as the completion type selection. Fault activation or fault re-activation is another failure mechanism that can be beneficially identified before drilling begins. Identifying minor fault or major fault areas that have the potential to activate during pore pressure depletion and to cause many undesirable effects can greatly influence completion selection. Historically, a dramatic increase in bottom hole pressure can occur just before a well fails according to a fault re-activation mechanism. Additionally, mobility of the bedding plains at the top of the reservoir can also indicate fault re-activation, as a result of extreme shear failure during the compaction mode. Identifying fault activation or re-activation during a pre-drill evaluation can help to optimize the trajectory as well as the completion in an effort to minimize the potential for this type of failure. As indicated in table 76 of FIG. 2, typical completion options which help to alleviate the effect of fault re-activation on the productivity of the well include optimum well trajectory, perforation optimization, frac and pack completion, and limit drawdown.

The following examples can demonstrate how knowledge of a hydrocarbon reservoir from hydrocarbon recovery modeling can be utilized to assist in optimizing well design. If the potential failure mechanism identified is reservoir compaction, two preferred completion options could include a frac and pack completion or an open hole horizontal well. A frac and pack completion is where the drilled well is hydraulically fractured by pumping a fluid into the wellbore and then packing the near wellbore with a supporting material. For a horizontal well, the actual stress phase determines the optimum direction for the well. Depending on the fault regime present, a horizontal well may be more stable in either the maximum stress direction or the minimum stress direction. But, it may not be readily apparent which one is the best choice. However, in a case where fracturing is the completion option, the preferred orientation for the fracture is in the direction of maximum stress. Therefore wells drilled for frac and pack completions should typically be aligned with the preferred fracturing plane when significant stress contrasts exist.

Multi-phase flow is another potential reservoir failure mechanism and can also induce production problems resulting from changes in the reservoir geo-mechanics. In a retrograde reservoir, assume the initial production is of a single-phase gas. As the reservoir is depleted the pressure declines and at a certain pressure the dew point of the gas is reached. From this point on, production becomes multi-phase due to the condensation forming in the reservoir at the lower pressures. Production goes from single-phase flow to multi-phase flow. This can cause additional drawdown on the reservoir when operated at the same flow rate as the previous single-flow of gas. If the well is produced without changing the choke size to accommodate the phase change at the dew point pressure of the gas, the higher drawdown can stress the near wellbore region to the extent of creating a failed well. Extremely high drawdown can stress the formation considerably more than normal pore pressure depletion predictions can project, and can have a dramatic effect on the geo-mechanics of the reservoir. Similarly, if initial production is oil and the reservoir pressure reaches the bubble point of the oil, the same multi-phase issues become relevant. As indicated in table 78 of FIG. 2, typical completion options that help to alleviate the effect of multi-phase flow on the productivity of the well include horizontal well, hydraulic fracturing, and stimulation.

Figure 3:
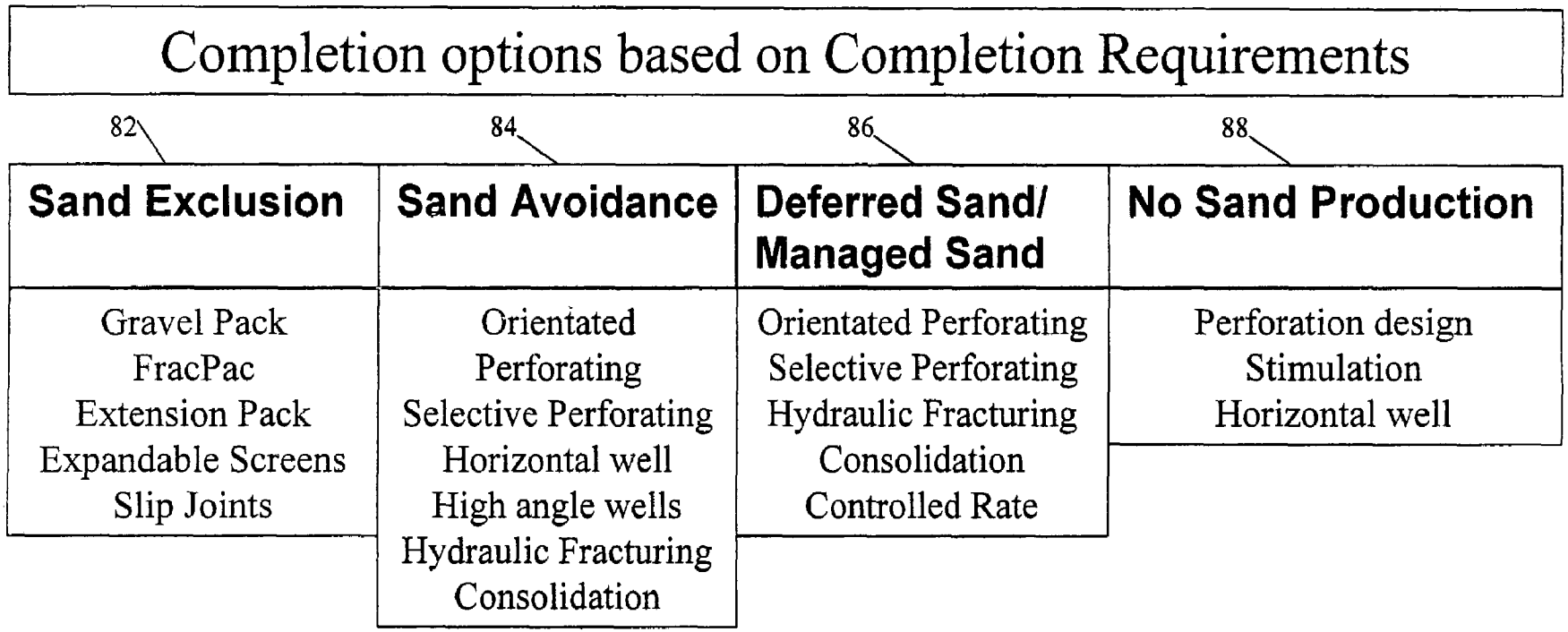
FIG. 3 is a table of well completion options based on identified completion requirements.

FIG. 3 provides a table of completion options based on completion requirements such as sand control issues and other productivity considerations. In box 80 of FIG. 1, completion options are considered based on specific completion requirements. FIG. 3. shows how the specified completion requirements can impact completion selection. For illustration, the completion requirements are listed including reservoirs requiring completions for sand tolerance concerns such as sand exclusion, sand avoidance, deferred sand/managed sand, and no sand production.

Sand tolerance is one of many possible completion requirements for consideration. Production facilities, environmental issues, and safety concerns help to determine the level of sand production that can be tolerated. Higher levels of sand production can erode surface facilities or can even fill up the facilities with sand. Special facilities can be installed to allow removal of certain amounts of sand to prevent excessive erosion. However, determining how much sand can be managed economically considering that the sand should be disposed of properly, then becomes an issue. In some instances, certain amounts of sand may be acceptable, and in others no sand production can be tolerated. Completion requirements to accommodate sand issues such as these are well known to those of skill in the art. For example, in a situation of shear failure as previously described, there is a near wellbore permeability loss and therefore adjustments may be made accordingly for appropriate completions with the near wellbore concerns regarding sand control considered.

If sand exclusion is identified as a completion requirement to accommodate production rate requirements, table 82 of FIG. 3 lists appropriate completion options for consideration in well planning and includes gravel pack, frac and pack, extension pack, expandable screens and slip joints. If sand avoidance is identified then the appropriate completion options to consider, as listed in table 84, include orientated perforating, selective perforating, horizontal well, high angle wells, hydraulic fracturing, and consolidation. If deferred sand/managed sand is identified as a requirement to accommodate productivity issues then table 86 lists the appropriate completion options for this situation including orientated perforating, selective perforating, hydraulic fracturing, consolidation, and controlled rate. If no sand production is identified then table 88 lists the appropriate completion requirements and includes perforation design, stimulation, and horizontal well.

Like far-field failure mechanisms, near wellbore potential failure mechanisms resulting in sand production are also a function of pore pressure depletion. Sand production is also a function of rock strength and production rate requirements. Additionally, sand production can be a function of the overall reservoir failure mechanisms. The failure point of the sand grain can be evaluated according to the failure envelope information of the hydrocarbon recovery modeling boxes 30, 40, 50. Sand management can be affected by completions and wellbore placement, for example it is recommended to gravel pack a horizontal well when sand production is a concern. The wellbore stability depends on sand strength, the velocities through the sand, minimal strain, and oriented perforations. Ideally, when sand problems are a concern, if the well is designed and completed with this in mind, orienting the wellbore correctly through the formation, accounting for stress magnitudes and direction and wellbore stability, in accordance with this invention, the rock may never fail throughout the life of the well.

FIG. 4 is a diagram depicting a Mohr Coulomb failure envelope. The Mohr Coulomb failure envelope is an example of a relatively simple hydrocarbon recovery model that can be used to help identify reservoir failure modes in box 70 of FIG. 1. FIG. 4 provides a graphical way to visualize stress states that represents failure modes such as tensile failure, cohesive failure, shear failure, and pore collapse or compaction failure. Given the complexities of other known models, the relatively simple Mohr Coulomb failure envelope will be discussed here for clarity and ease of understanding.

FIG. 4 is a typical plot of a Mohr Coulomb failure envelope. The X-axis represents the effective normal stress (perpendicular to the plane) and the Y-axis represents the shear stress (parallel to the plane). The normal stress increases with compression in the positive X direction and decreases with tension in the negative X direction. The failure envelope 130, 140, 150 is the best-fit line representing the locus of shear and normal stresses at failure for a material, such as a core sample, taken from laboratory results. Stress states below this line are considered stable and above this line are unstable.

In the laboratory, failure points are determined by breaking core samples under different confining stresses that can later be translated to pore pressure conditions. The triaxial compression laboratory test procedures and calculations to achieve the failure envelope are known to those skilled in the art. Applying a confining pressure to a core in a laboratory test can be very similar in principle to applying pore pressure to the material in the formation. Therefore, confining pressures defined in the lab can be extrapolated into pore pressures to predict failure in the field.

Accordingly, the graph shown in FIG. 4 includes two Mohr Coulomb semicircles 110 and 120 to represent reservoir stress states in time. Curve 110 in FIG. 4 represents initial stress conditions in the reservoir and is plotted by using the stress conditions evaluated at the pore pressure calculated at initial conditions. Curve 120 in FIG. 4 represents stress conditions evaluated at the pore pressure calculated under drawdown and production as determined by hydrocarbon recovery modeling. Hydrocarbon fluids that occupy the pore spaces in the reservoir rock of a hydrocarbon formation can reduce the normal stress. As the reservoir is produced, the change in pore pressure can result in going from stable to unstable rock conditions resulting in failure. As the reservoir is predicted to be depleted by hydrocarbon recovery modeling, the pore pressure is reduced which shifts the two points where curve 110 intercepts the horizontal axis both to the left at the left-most end of the semi-circle, and to the right at the right-most end of the semi-circle, basically growing the semi-circle out as drawdown and production occurs as is shown by curve 120. Where the semi-circle 120 intersects the failure line 130, this corresponds to pore pressures that initiate unstable conditions. In this particular example shown in FIG. 4, the Mohr Coulomb failure envelope helps to show that as conditions change in the life of a well, shear failure can occur.

When operating a well at stress states inside of the failure envelope 130, 140, 150, the reservoir rock can be considered stable. However, when operating at stress states outside of the envelope then the reservoir rock can be considered unstable and failure is likely. Tensile failure is graphically illustrated to occur in the region to the left of the Y-axis and below the X-axis, when the effective normal stress is negative. If a well is operating with stress states in this region it can fail in tension. This is what occurs when a well undergoes hydraulic fracturing. Some water injection wells typically operate in this region of the graph.

The failure envelope intersects the Y-axis when there is no effective normal stress. The magnitude of the shear stress at this point represents the cohesive strength of a material (the bonding strength between the particles of a material). Cohesive failure can be expected at this point. Cohesive failure is a surface failure phenomenon that is generally not a critical component in a completion evaluation because typically it is a temporary event that clears up on its own after being produced for a short period of time. With cohesive failure a small amount of sand is produced initially but as the well continues to be produced the sand production generally stops. Producing a well at stress conditions conducive to cohesive failure could be an ideal case for a managed sand production completion design.

The slope of the failure envelope is the ratio of the shear stress to the normal stress at failure and is a straight line 130 in FIG. 4 up to a point 140 at which the line becomes a curve 150 bending down toward the X-axis. The region of the graph above the straight-line portion of the failure envelope and to the left of a vertical line through point 140 can be considered an area when shear failure in the reservoir is probable. Shear failure initiates with the onset of grain shifting that eventually liberates fines migration. This can cause a reduction in permeability in the near wellbore region as already discussed. In sand prediction models, shear failure is often associated with the onset of significant sand production as well.

The area above the curved portion of the failure envelope 150 and to the right of a vertical line through point 140 is a region when pore collapse failure due to compaction can be expected. Determination of the point 140 allows the cap 150 to be inserted on the failure envelope to predict compressive-failure. Pore collapse, or compaction failure, is a far field effect as mentioned previously.

The Mohr Coulomb failure envelope is an example of a relatively simple hydrocarbon recovery model that can typically provide a good visualization tool to indicate potential failure modes; but it is not designed to handle all the complexities of non-elastic or plastic type failure modes. The Mohr Coulomb failure envelope is an elastic solution and it does not consider plastic deformation conditions. Elastic deformation conditions are observed when a material is deformed with stress and then when the stress is removed the material returns to its original form. Plastic deformation conditions are observed when a material is deformed beyond its elastic limits, meaning the material is permanently changed, so that when the stress is released, it no longer can go back to its initial condition. Sheer failure can typically be considered to be more of a plastic failure mode. Pore collapse is also considered a plastic failure mode. Accordingly, some reservoir evaluations may require a more rigorous solution taking into consideration the plastic-elastic finite element models that are readily available, such as known Drucker-Prager and Modified Lade models. These more sophisticated models use more complex elastic-plastic failure modeling that requires a multitude of core testing at different confining stresses to generate them. It is quite a complex process to develop one of these more sophisticated failure envelopes.

Once the failure mode or modes have been determined through hydrocarbon recovery modeling such as was just described in the above example using a simple Mohr Coulomb failure envelope or by using some other model or combination of models, the process to optimize selection of completion and well design continues on to box 80 of FIG. 1 as already described earlier herein.

Typically, hydrocarbon recovery modeling has incorporated geo-mechanical modeling to help with drilling operations planning, where the primary concern is wellbore stability during drilling. In particular, geo-mechanical models that are most readily available right now have traditionally been focused on optimizing the drilling process, for example determining the right direction for optimum wellbore stability, to prevent a loss of circulation or a hole collapse. As illustrated in FIGS. 1–4, the process in accordance with the present invention illustrates how these same tools may be used to do a better job of completing the well. A potential benefit is that by planning the completion type in advance of drilling using the geo-mechanical model in combination with reservoir modeling and all other available reservoir information obtained from well data and subsequent hydrocarbon recovery modeling presents an opportunity to optimize the wellbore to be drilled for the selected completion.

Typically, at the completion stage, the well planning and drilling is already done. Historically, if geo-mechanics were used in hydrocarbon recovery modeling and evaluation, they were used from the standpoint of borehole stability and drilling optimization. Therefore, at the completion stage, the wellbore has already been drilled without completion selection or design considered and now is to be evaluated for completion selection and design for the borehole in place. Doing a better job of completing the well can have a long-term effect on the life and productivity of the well. The system and process described herein enables an optimal pre-drill completion selection, so that the optimal borehole can then be planned and drilled to fit the best completion option for the reservoir particulars.

Figure 5:
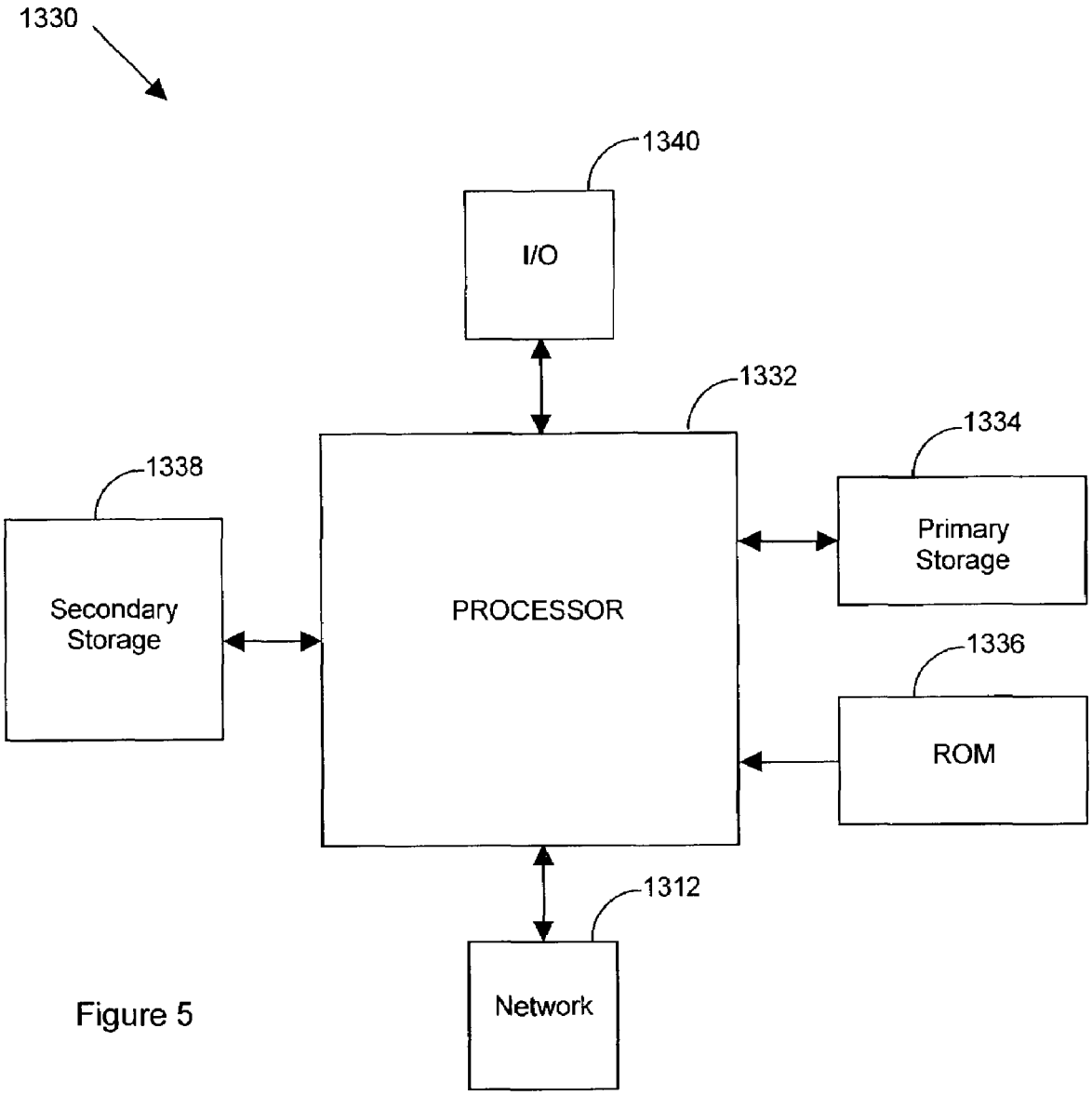
FIG. 5 illustrates a typical, general-purpose computer system upon which a process in accordance with the present invention could be run in whole or in part.

A process for selecting well completion and design as described herein may generally be implemented in whole or in part on a variety of different computer systems. FIG. 5 illustrates a typical, general-purpose computer system suitable for implementing the present invention. The computer system 1330 includes a processor 1332 (also referred to as a central processing units, or CPU) that is coupled to memory devices including primary storage devices 1336 (typically a read only memory, or ROM) and primary storage devices 1334 (typically a random access memory, or RAM).

As is well known in the art, ROM acts to transfer data and instructions uni-directionally to CPU 1332, while RAM is used typically to transfer data and instructions in a bi-directional manner. Both storage devices 1334, 1336 may include any suitable computer-readable media. A secondary storage medium 1338, which is typically a mass memory device, is also coupled bi-directionally to CPU 1332 and provides additional data storage capacity. The mass memory device 1338 is a computer-readable medium that may be used to store programs including computer code, data, and the like. Typically, mass memory device 1338 is a storage medium such as a non-volatile memory such as a hard disk or a tape which is generally slower than primary storage devices 1334, 1336. Mass memory storage device 1338 may take the form of a magnetic or paper tape reader or some other well-known device. It will be appreciated that the information retained within the mass memory device 1338, may, in appropriate cases, be incorporated in standard fashion as part of RAM 1336 as virtual memory. A specific primary storage device 1334 such as a CD-ROM may also pass data uni-directionally to the CPU 1332.

CPU 1332 is also coupled to one or more input/output devices 1340 that may include, but are not limited to, devices such as video monitors, track balls, mice, keyboards, microphones, touch-sensitive displays, transducer card readers, magnetic or paper tape readers, tablets, styluses, voice or handwriting recognizers, or other well-known input devices such as, of course, other computers. Finally, CPU 1332 optionally may be coupled to a computer or telecommunications network, e.g., an internet network, or an intranet network, using a network connection as shown generally at 1312. With such a network connection, it is contemplated that CPU 1332 might receive information from the network, or might output information to the network in the course of performing the process in accordance with the present invention. Such information, which is often represented as a sequence of instructions to be executed using CPU 1332, may be received from and outputted to the network. The above-described devices and materials will be familiar to those of skill in the computer hardware and software arts.

In one embodiment, sequences of instructions may be executed substantially simultaneously on multiple CPUs, as for example a CPU in communication across network connections. Specifically, the above-described process may be performed across a computer network. Additionally, it will be recognized by one of skill in the art that the process may be recognized as sets of computer codes and that such computer codes are typically stored in computer readable mediums such as RAM, ROM, hard discs, or floppy discs and the like.

While the preferred embodiments of the invention have been shown and described, modifications thereof can be made by one skilled in the art without departing from the spirit and teachings of the invention. The process for selecting well completion type and design and the like for any given implementation of the invention will be readily ascertainable to one of skill in the art based upon the disclosure herein. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim.

Accordingly, the scope of protection is not limited by the description set out above, but is only limited by the claims which follow, that scope including all equivalents of the subject matter of the claims. Each and every claim is incorporated into the specification as an embodiment of the present invention. Thus the claims are a further description and are an addition to the preferred embodiments of the present invention.

What is claimed is:

1. A process for selecting well completion design before drilling a proposed well comprising:

considering hydrocarbon recovery models relating to a proposed well;

determining completion design for desired hydrocarbon recovery over the life of the proposed well; and storing the completion design in a computer readable medium;

wherein considering the hydrocarbon recovery models comprises determining the effect of pore pressure depletion on well production over the life of the well.

2. The process of claim 1 wherein the hydrocarbon recovery models comprise a geo-mechanical model.

3. The process of claim 1 wherein the hydrocarbon recovery models comprise a reservoir model.

4. The process of claim 1 wherein the hydrocarbon recovery models comprise a material model.

5. The process of claim 1 further comprising considering the impact on well completion given the determined effect of pore pressure depletion on well production over the life of the well.

6. The process of claim 5 further comprising identifying completion options based on the determined effect of pore pressure depletion on well production over the life of the well.

7. The process of claim 1 wherein considering the hydrocarbon recovery models comprises determining the probable failure mechanism for the proposed well.

8. The process of claim 7 further comprising considering the effect of the determined probable failure mechanism on well production.

9. The process of claim 8 further comprising identifying completion options based on the determined probable failure mechanism for the proposed well.

10. The process of claim 1 wherein considering the hydrocarbon recovery models comprises identifying completion requirements.

11. The process of claim 10 further comprising determining the effect of identified completion requirements on well completion.

12. The process of claim 11 further comprising identifying completion options based on the determined effect of identified completion requirements.

13. The process of claim 1 further comprising selecting optimum completion design for hydrocarbon recovery over the expected life of the proposed well.

14. The process of claim 1 wherein determining completion design comprises selecting a completion type.

15. The process of claim 1 wherein determining completion design comprises selecting a completion trajectory.

16. The process of claim 1 wherein determining completion design comprises selecting a completion location.

17. The process of claim 1 further comprising drilling and completing the well based on determination of completion design.

18. The process of claim 17 further comprising updating information used in the hydrocarbon recovery models based on data obtained during drilling and completion of the well.

19. The process of claim 18 further comprising repeating the process for each new proposed well.

20. A process for selecting well completion design before drilling a proposed well comprising:

considering hydrocarbon recovery models relating to a proposed well;

determining completion design for desired hydrocarbon recovery over the life of the proposed well; and storing the completion design in a computer readable medium;

wherein considering the hydrocarbon recovery models comprises determining the effect of pore pressure depletion on the hydrocarbon recovery models and the corresponding effect on predicted well production.

21. A process for selecting well completion design before drilling a proposed well comprising:

considering hydrocarbon recovery models relating to a proposed well;

determining completion design for desired hydrocarbon recovery over the life of the proposed well; and storing the completion design in a computer readable medium;

wherein the hydrocarbon recovery models provide information regarding pore pressure depletion, stress magnitudes and orientations, and strength of rock formation.

22. Computer-readable media tangibly embodying a program of instructions executable by a computer to perform a process for selecting well completion design before drilling a proposed well, the process comprising:

considering hydrocarbon recovery models relating to a proposed well;

determining completion design for desired hydrocarbon recovery over the life of the proposed well; and storing the completion design in a computer readable medium;

wherein the hydrocarbon recovery models provide information regarding pore pressure depletion, stress magnitudes and orientations, or strength of rock formation.

23. Computer-readable media tangibly embodying a program of instructions executable by a computer to perform a process for selecting well completion design before drilling a proposed well, the process comprising:

considering hydrocarbon recovery models relating to a proposed well;

determining completion design for desired hydrocarbon reconvey over the life of the proposed well; and storing the completion design in a computer readable medium;

wherein considering the hydrocarbon recovery models comprises determining the effect of pore pressure depletion on well production over the life of the well.

24. The media of claim 23 wherein the hydrocarbon recovery models comprise a geo-mechanical model, a reservoir model, or a material model.

25. The media of claim 23 further comprising identifying completion options based on the determined effect of pore pressure depletion on well production over the life of the well.

26. The media of claim 23 wherein considering the hydrocarbon recovery models comprises determining the probable failure mechanism for the proposed well.

27. The media of claim 26 further comprising identifying completion options based on the determined probable failure mechanism for the proposed well.

28. The media of claim 23 wherein considering the hydrocarbon recovery models comprises determining the effect of identified completion requirements on well completion.

29. The media of claim 28 further comprising identifying completion options based on the determined effect of identified completion requirements.

30. The media of claim 23 further comprising selecting optimum completion design for hydrocarbon recovery over the expected life of the proposed well.

31. The media of claim 23 wherein determining completion design comprises selecting a completion type, trajectory, or location.

32. The media of claim 23 further comprising updating information used in the hydrocarbon recovery models.

33. A process for the consideration of hydrocarbon recovery models in the selection of well completion before drilling the well comprising evaluating the hydrocarbon recovery models based on pore pressure depletion over the life of the well, and storing the hydrocarbon recovery models in a computer readable medium.

* * * * *